United States Patent [19]

Broodman

[11] 4,183,558

[45] Jan. 15, 1980

[54] METHOD FOR WELDING BY PRESSURE ONE OR MORE PIPES TO A PLATE IN ONE PROCESS

[75] Inventor: Johannus J. Broodman, Breskens, Netherlands

[73] Assignee: B.V.Koninklijke Maatschappij "De Schelde", Vlissingen, Netherlands

[21] Appl. No.: 874,773

[22] Filed: Feb. 3, 1978

[30] Foreign Application Priority Data

Oct. 12, 1977 [NL] Netherlands ..... 7711204

[51] Int. Cl.[2] ..... B23K 21/00

[52] U.S. Cl. ..... 285/189; 228/115; 228/173 A; 228/265

[58] Field of Search ..... 228/115, 116, 173 A, 228/173 F, 265; 29/520, 157.4; 285/222, 286, 189

[56] References Cited

U.S. PATENT DOCUMENTS

| | | | |
|---|---|---|---|
| 3,349,465 | 10/1967 | Pan et al. | 29/157.4 |
| 3,535,762 | 10/1970 | Taylor | 228/265 X |
| 3,664,012 | 5/1972 | Wilke et al. | 228/115 X |
| 3,886,649 | 6/1975 | Simon | 228/173 A X |
| 3,922,768 | 12/1975 | Takayasu | 29/157.3 R |
| 3,934,116 | 1/1976 | Cunningham et al. | 29/520 X |

FOREIGN PATENT DOCUMENTS

| | | |
|---|---|---|
| 633615 | 2/1928 | France . |
| 908952 | 4/1946 | France . |
| 1189021 | 9/1959 | France . |
| 1291753 | 3/1962 | France . |
| 2267844 | 11/1975 | France . |
| 132182 | 9/1971 | Netherlands . |
| 877580 | 9/1961 | United Kingdom . |

*Primary Examiner*—Francis S. Husar
*Assistant Examiner*—K. J. Ramsey
*Attorney, Agent, or Firm*—Bucknam and Archer

[57] ABSTRACT

The present invention provides a certain improvement in the method for connecting a pipe to a plate by high pressure welding. This basic method is one in which the pipe is inserted a certain distance into a bore provided in the plate and subsequently the material of the pipe is spread out over the wall surface defining the bore of the plate, under the influence of high pressure and with the aid of a mandrel disposed in the pipe.

The improvement provided by the invention basically comprises the steps of positioning within a cooperating punch and die set, the plate with an end section of the pipe inserted into the bore of the plate. The punch and die set have opposed aligned bores accommodating the extension therethrough of the pipe and a mandrel respectively. In addition the punch and die set generally confine the plate at the peripheral edge and opposite sides thereof, and are operable to apply compressive forces to the opposite sides of the plate. The mandrel is inserted into the pipe such a distance that the mandrel extends completely through the end section of the pipe and a free end of the mandrel is located within the pipe and within one of the aligned bores of the punch and die set.

Using the punch and die set, compressive forces are applied to the opposite sides of the plate, while the mandrel is inserted in the pipe, so as to deform the material of the plate in the region of the bore thereof and to deform the material of the pipe end section in the plate such that the plate material and pipe end section material are pressed against the mandrel. While maintaining these compressive forces, the mandrel is withdrawn from the pipe and out of the bore of the plate so as to spread out in the mandrel withdrawal direction, and over a boundary surface portion of the plate bore, the deformed pipe end section material and thereby form a welded joint.

4 Claims, 1 Drawing Figure

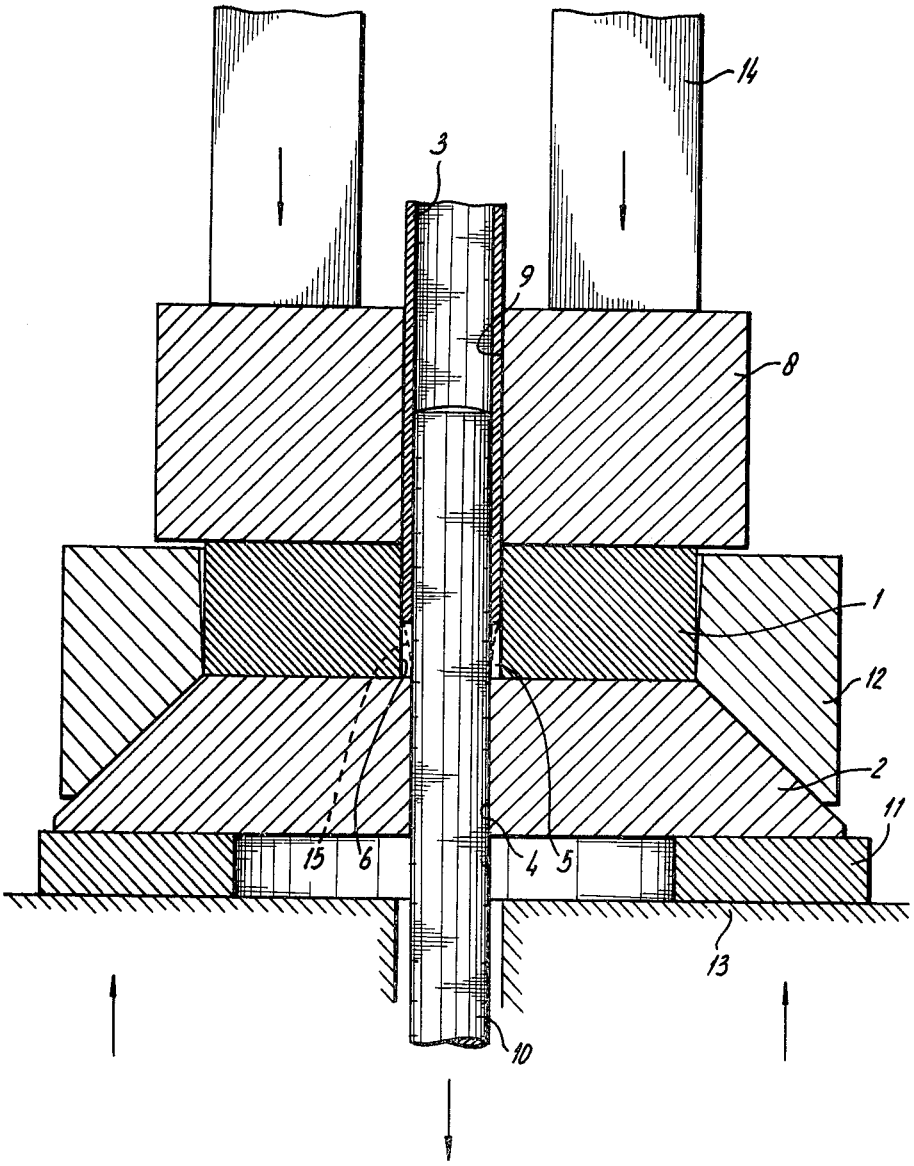
14
3
9
8
1
12
2
11
15
6
4
5
13
10

METHOD FOR WELDING BY PRESSURE ONE OR MORE PIPES TO A PLATE IN ONE PROCESS

The present invention relates to a method for connecting at least one pipe to a plate by pressure welding, in which a pipe is slid over a certain distance into the bore of a plate and in which subsequently the material of said pipe, with the aid of a mandrel disposed in the pipe, is spread out over the bore-wall surface under high pressure and is pressed against said wall, whereby a welded joint is being formed.

With said method, the pipe and the mandrel provided in the pipe are slid into the bore from one side. In its outer end section disposed in the bore, the pipe has been provided with an inwardly directed, tapered enlarged edge. The material of said edge is deformed when the mandrel is slid further into the pipe and is pressed against the inner wall of the bore, as a result of which a joint by pressure welding is obtained.

Without the tapered, enlarged edge it is still possible to effect a weld e.g. by using a profiled mandrel, around which the material is extruded by putting the plate material under pressure. When the mandrel is being withdrawn, the material is deformed sufficiently as to effect a weld. In both cases, the pressure during the process of deformation is developed by the fact that the mandrel forces the material upwards against the plate material.

With experiments of this kind, it was found that the wall thickness of the pipe is considerably reduced at the region of the weld, e.g. the wall thickness of 1 mm of an aluminum pipe is reduced to approximately 0.3 mm at the region of the weld. If an increase in wall thickness is required, the methods described so far do not seem to offer a solution. Even if for the base material for the pipe an increase in wall thickness is chosen of e.g. 2 or 3 mm, the thickness of the deformed pipe at the region of the weld will not exceed much the value of approximately 0.3 mm. It is true that in many cases the method described will be satisfactory but, from the point of view of strength a method is preferred in which only a minimal reduction of wall thickness is involved.

With the method in accordance with the invention, at least at the beginning of the welding process between pipe and plate said reduction of thickness is avoided.

A highly important disadvantage in the case of the pipe enlarged at the end is the fact that the mandrel must be slid through the pipe from the pipe end facing away from the plate. In practice, this is only feasible with very short pipe sections.

With long or bent pipes, as with heat exchangers and cascase-pipe-systems onto which ultracentrifuges are connected in so-called enrichment plants, it is difficult to use said method, because the mandrel cannot be slid into the pipe from the side of the plate and be moved through the full pipe length, particularly when said pipe is curved and when said pipe has been provided with an enlarged edge.

With a profiled mandrel, it is possible to insert same into the pipe from the side of the plate; however, this method of passing the material through the bore has the disadvantage that the mandrel is strongly contaminated by the adhering material or that welding on the mandrel necessitates a regular cleaning of said mandrel. In both cases, the draw-back of a considerable reduction of wall thickness of the pipe remains.

When there is hardly any pressure, there is almost the same reduction of the pipe-wall thickness before the welding process begins. In accordance with the invention, the pressure may be set such that depending on the kind of material no reduction of wall thickness occurs at the starting region of the welded joint during the withdrawal of the mandrel.

An increase in temperature of plate and pipe material may advance the welding process, i.e. with an increase in temperature the pressure on the plate and pipe material may be lower and the force by which the mandrel is withdrawn from the bore will be reduced.

A typical character of welds obtained with the method according to the invention is that these welds are of considerable length. With pipes having a diameter of e.g. 10 mm and a wall thickness of 1 mm the length of the weld may even amount to 20 mm, which improves the operating reliability and which, in the case of rapid changes of temperature forced upon the pipe-wall via a medium in the pipe, will not result in stresses leading to rupture, due to the proper bond.

Good results have been obtained e.g. in that for aluminum types the material is heated up to 300°–500° C. during the process of welding.

The method is particularly useful for securing a large number of pipes to plates in one process step, the advantage being that the welds of the different pipes do not affect each other.

If required, the bore in the pipe plate may be enlarged at the region of the inserted pipe end section. In doing so, the pipe end section must fit tightly into the enlarged bore in the pipe plate while the end of said pipe section will abut against a shoulder of the bore portion not being enlarged, said shoulder being disposed transversely to the bore.

The invention will now be described more in detail with reference to the drawing illustrating partly in section and partly in elevation one embodiment of the device for carrying out the method according to the invention.

In the accompanying FIGURE a round pipe plate 1 has been disposed in a die constituted by a cylindrical portion 12 and a flat part 2. In the present case, the plate constitutes a flange for a pipe 3 to be secured to said plate 1. The pipe plate or flange 1 and the pipe 3 may consist of aluminum or another material or combinations of materials which are difficult to join or cannot be joined at all by fusion welding.

In accordance with the invention, it is the object of this method to connect pipes to flanges which are to be connected with ultracentrifuges in uranium enrichment plants. In doing so, generally three pipes are secured to a round flange, and the flange is subsequently mounted on the centrifuge.

The methods used so far, e.g. by means of fusion welding or explosive welding are either too expensive or in the last case unreliable. A considerable disadvantage of the methods used so far is that the distance between the pipes connected in one pipe plate remains, in fact, too large, with all the consequences for the apparatus to be connected. Even in heat exchangers, a reduction of the pitch, i.e. the distance between the pipes, may certainly improve the efficiency of the heat exchanger. In all cases, the limiting disadvantageous factor lies in the process of welding for connecting the tubes to the plate.

With the method according to the invention it was found possible to carry out the welding operation even when only a minor wall of e.g. 1.5 to 2 mm is required between the bores and without any loss of quality of the welds.

According to the method of the present invention joints by pressure welding between the pipe 3 and the flanges 1 are feasible in a very simple and fast manner and of high quality, in which the distance between the pipes may be small.

The die 2, 12 has been provided with a bore 4 lying in the extension of a bore 5 in flange 1 and having a smaller diameter than bore 5. In the present case, the flange 1 is provided only with one bore, as die portion 2. In the afore-mentioned example with three pipes on one flange, said bores may lie e.g. according to the vertices of an imaginary equilateral triangle, but also in one line, depending on the purpose for which they are used.

Subsequently, a punch 8 is disposed on the top surface still free of flange 1, said punch being provided with a bore 9 fitting closely around pipe 3 in order to prevent material of flange 1 from being pressed between punch 8 and pipe 3.

A mandrel 10 is being slid upwards into the flat die portion 2 through bore 4 and then into flange 1 through bore 5 until its front section reaches sufficiently far into the section of pipe 3 being present in the bore 9 of punch 8. It is preferred that said mandrel 10 fits slidingly but without play in the bore 4 of the flat die portion 2, in addition to prevent material of flange 1 from being pressed between mandrel 10 and die portion 2; also, the least possible clearance should remain between the outer wall of the mandrel 10 and the inner wall of pipe 3.

The flat portion 2 of the die is supported by an insulating ring 11 resting on a table 13 in order to prevent an excessive temperature increase of the table when the material of the device is being heated. A pressing element 14 presses a punch 8.

The connection of pipe 3 to flange 1 according to the method of cold welding is made as follows: The punch 8 is pressed against flange 1 by the pressing element 14 with such a force, while die 2, 12 is supported by table 13, that the material of flange 1 and the section of pipe 3 in bore 5 of said flange are being subjected to a load up to the region of plastic deformation of the material of flange 1 and pipe 3.

During said plastic deformation of flange 1, material of said flange is being pressed into the space remaining between mandrel 10 and inner wall 6 of bore 5 until said cylindrical cavity has been filled with the material of the flange. Under said material load and material deformation and while keeping a pressure depending on the type of material, the mandrel 10 is subsequently withdrawn downwards from bore 5 in flange 1. In doing so, part of the material of the pipe end section in flange 1 is drawn along downwards and spread out over the material of flange 1 while the yield-point of pipe and flange material is exceeded, said flange material now being pressed against mandrel 10 in the previous cylindrical space between mandrel 10 and bore-wall 6. In doing so, material of flange 1 is pressed back again. The margin between the material of flange 1 and pipe 3 has been roughly indicated by dotted lines 15.

The welded joint between pipe 3 and flange 1 runs from an area near the lower end of pipe 3 in the original position down to the surface of flange 1 resting against die section 2. Thus, pipe 3 has been joined to flange 1 over a comparatively long distance. In the case of using this pipe-plate connection in the process of ultracentifuge, the gap remaining between pipe 3 and bore 5 in flange 1 (illustrated in the drawing in the upper side of flange 1) does not lie at the process side, so that substances, if any, penetrating into the gap do not cause any danger of corrosion. At the lower side, where the pipe material is spread out over the bore wall surface, no gap of material will be formed so that no substances can penetrate here; consequently, said joint has outstanding qualities for high-vacuum systems.

With certain types of material, an ultrasonic vibration may be additionally exerted on the mandrel 10, as a result of which oxide skin, which may have been formed, is being scoured and welding can be carried out at lower pressures. For a proper joint between the pipe and the flange, a clean surface of the abutting parts is conducive but not required for all materials.

In the drawing, the cylindrical part 12 on the inside is widened at its top for receiving the material of flange 1 during the pressing, as a result of which the flange can be more easily removed from the die.

Although the present invention has been described in some detail by way of illustration and example of purposes of clearity of understanding, it is understood that numerous changes and modifications may be practiced within the scope of the invention as limited only by the scope of the claims appended hereto. For example, non-cylindrical pipes can also be successfully welded according to the same method to plates with bores adjusted to such pipes.

What is claimed is:

1. In the method for connecting a pipe to a plate by high pressure welding in which the pipe is inserted a certain distance into a bore provided in the plate and subsequently the material of the pipe is spread out over the wall surface defining the bore of the plate, under the influence of high pressure and with the aid of a mandrel disposed in the pipe, the improvement which comprises the steps of positioning within a cooperating punch and die set, the plate with an end section of the pipe inserted into the bore of the plate a distance less than the length of the bore, said punch and die set having opposed aligned bores accommodating the extension therethrough of the pipe and a mandrel respectively, said punch and die set generally confining said plate at the peripheral edge and opposite sides thereof, and being operable to apply compressive forces to said opposite sides of the plate; inserting said mandrel into the pipe such a distance that the mandrel extends completely through said end section of the pipe and a free end of the mandrel is located within the pipe and within one of said aligned bores of the punch and die set, said mandrel being slidable into the pipe with a close fit therewith; applying, with said punch and die set, compressive forces to said opposite sides of the plate, while said mandrel is inserted in the pipe, to deform the material of the plate in the region of the bore thereof and to deform the material of the pipe end section in said plate bore such that said plate material and pipe end section material are pressed against the mandrel; and, withdrawing the mandrel from the pipe and out of the bore of the plate while maintaining said compressive forces to spread out in the mandrel withdrawal direction and over a boundary surface portion of the plate bore, said deformed pipe end section material and thereby form a welded joint.

2. A method according to claim 1 wherein said compressive forces are maintained so as to prevent reduction of wall thickness of the pipe at the beginning region of the welded joint produced during withdrawal of the mandrel.

3. A method according to claim 1 including the step of enlarging the bore of the plate before insertion of said pipe end section.

4. A joined-together pipe and plate product obtained by the method of claim 1.

* * * * *